US007846297B2

(12) United States Patent
Buller et al.

(10) Patent No.: US 7,846,297 B2
(45) Date of Patent: Dec. 7, 2010

(54) METHOD AND DEVICE IN A DRYER SECTION OF A FIBRE-WEB MACHINE, SUCH AS A PAPER OR BOARD MACHINE

(75) Inventors: Jyrki Buller, Helsinki (FI); Samppa J. Salminen, Jyväskylä (FI); Jussi Salojärvi, Jyväskylä (FI); Jyrki Savela, Jyväskylä (FI); Risto Väätänen, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 169 days.

(21) Appl. No.: 12/304,257

(22) PCT Filed: May 29, 2007

(86) PCT No.: PCT/FI2007/050305

§ 371 (c)(1),
(2), (4) Date: Dec. 10, 2008

(87) PCT Pub. No.: WO2007/144460

PCT Pub. Date: Dec. 21, 2007

(65) Prior Publication Data

US 2009/0321031 A1 Dec. 31, 2009

(30) Foreign Application Priority Data

Jun. 12, 2006 (FI) ..... 20065396

(51) Int. Cl.
*D21F 1/00* (2006.01)

(52) U.S. Cl. ..... 162/232; 162/272; 162/274; 162/199; 34/114; 34/116; 34/117; 34/120

(58) Field of Classification Search ..... 162/232, 162/272, 274, 199; 34/114, 116, 117, 120
See application file for complete search history.

(56) References Cited

U.S. PATENT DOCUMENTS

| | | | | |
|---|---|---|---|---|
| 3,598,039 | A | 8/1971 | Bryant | |
| 4,536,970 | A * | 8/1985 | Eskelinen | 34/454 |
| 5,666,740 | A * | 9/1997 | Leinonen et al. | 34/114 |

FOREIGN PATENT DOCUMENTS

| | | | |
|---|---|---|---|
| FI | 55536 | B | 4/1970 |
| FI | 83551 | B | 5/1989 |
| FI | 96329 | C | 2/1996 |
| WO | 96/34145 | A1 | 10/1996 |
| WO | 2007/144460 | A1 | 12/2007 |

OTHER PUBLICATIONS

Written Opinion of the International Searching Authority issued in PCT/FI2007/050305.
Search Report issued in PCT/FI2007/050305.
Search Report issued in FI 200653.

* cited by examiner

*Primary Examiner*—Mark Halpern
(74) *Attorney, Agent, or Firm*—Stiennon & Stiennon

(57) ABSTRACT

A hood (10) is located above a web forming section (12), a press section (14) and/or a dryer section and includes a ceiling (30), a back side wall, and a front side wall (44), which includes staggered wall segments (42). The wall segments (42) are adapted to move along rails or similar. The front side wall segments (42) are adapted to form two or more groups (46). A cleaning station (40) is arranged to automatically clean the side wall segments (42) as they move past the cleaning station.

13 Claims, 6 Drawing Sheets

METHOD AND DEVICE IN A DRYER SECTION OF A FIBRE-WEB MACHINE, SUCH AS A PAPER OR BOARD MACHINE

CROSS REFERENCES TO RELATED APPLICATIONS

This application is a U.S. national stage application of International App. No. PCT/FI2007/050305, filed May 29, 2007, the disclosure of which is incorporated by reference herein, and claims priority on Finnish App. No. 20065396, filed Jun. 12, 2006.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The object of the invention is a hood for a web forming, press and/or dryer section, the said hood being located above the web forming, press and/or dryer section and the said hood comprising a ceiling, a back side wall, and a front side wall comprising staggered wall segments adapted to move along rails or similar.

Covering a web forming and/or a forming section with a hood has been described in patents FI 83551 and FI 96329, for example. These patents state as advantages of such a hood a higher temperature in the press section and a decreased machine hall noise level, among others. These are indeed the essential advantages achieved with such solutions. However, constructing a hood creates significant problems; for example, maintenance becomes more difficult. In addition, the consequences include process problems caused by hood soiling and weakened possibilities for controlling the process. Hood soiling is a known problem also in the dryer section. Constructing a hood is also a large project for both the web forming and forming sections as well as for the dryer section.

SUMMARY OF THE INVENTION

The object of the invention is to provide an improved hood for a web forming, press and/or dryer section. Wall segments form two or more groups, which are independent modules of which the hood is constructed.

With a hood located above a web forming, press and/or dryer section, a better than before dry content after the press section can be achieved because the hood can be used to increase the temperature in the press section. A hood located above a web forming section, in turn, can remarkably reduce the noise carried to the machine hall from the machine, in the dryer section the hood contributes significantly to the heat recovery. A hood located above a web forming, press and/or dryer section is suitable for use in connection with paper, board, tissue, and pulp machines. The hood comprises a ceiling, back side and front side walls. The front side wall includes staggered wall segments. The wall segments move supported by rail constructions or similar. Surprisingly the wall segments form two or more groups. The groups thus formed function as modules of which the hood is constructed. When constructing the hood on site using modules, the assembly stage becomes notably faster. With a careful design of an entirety composed of modules the costs produced by the hood can be considerably decreased. The wall segments can be implemented with access doors in which case the entire wall segment does not need to be opened at a web break, for example. In addition, the lowest part of the wall segments, at about 2 meters distance from the floor, can be advantageously lifted. The lowest part of the wall segments can be lifted during a break, for example, avoiding thus heat escaping the hood. Preventing the heat escape is very important particularly in the dryer section but significant also in the press section when increasing its temperature.

In one embodiment the hood includes an openable front cover. Here the front cover refers to a cover located in the initial part of the machine, protecting essentially the first meters of the web forming section. The front cover differs from the ceiling and the walls in that it is not merely vertical or horizontal. The front cover is thus an essentially inclined or curved protecting construction. This inclination enables a reduction of unnecessary space within the hood. When the front cover is opened, an opening is created. This opening enables a freer access to the headbox maintenance. Through the opening, it is also possible to change rolls, provided that the opening extends to above the rolls. In addition, through the opening created by the removal of the front cover, it is easier to carry out operations on the machine during repairs, because the opening is closer to the maintenance object than an opened ceiling. A front cover also protects the bottom part of the gap former fabric as well as the operating personnel from this fabric.

Moist conditions dominating in the web forming and press sections contribute to intensive hood soiling. The hood can be divided to moisture/heat departments with separating walls. Thus for example the dryer section can be separated from the web forming and the press sections. The web forming section and the press section can also be separated from each other with separating walls. Dividing into departments can improve the heat recovery. In addition, dividing into departments can limit hood soiling. Hood cleaning is particularly important due to soiling. The hood ceiling constructions can be cleaned during shutdowns, but this is not necessarily sufficient in a heavily soiling environment. In another embodiment, the hood surprisingly includes a dirt-collecting intermediate structure and its cleaning equipment set between the hood ceiling and the web forming and/or the press section. The cleaning equipment is used to clean the surface below the intermediate structure. An intermediate structure and cleaning equipment enables a hood from the ceiling of which dripping of impurities onto the web is prevented. Impurities do not drip because the intermediate structure is cleaned throughout the entire production process. In addition, the intermediate structure and the ceiling can be cleaned for example by washing more thoroughly during shutdowns. With continuous cleaning of the hood's intermediate structure it is possible to avoid problems provided with soiling. The productivity increases because increasing the press section temperature enables a higher dry content after the press section, i.e. the machine speed can be increased. On the other hand, with efficient hood cleaning, soiling does not cause problems to the process. Thus it is possible to achieve an application, in which the productivity is at a higher level than before.

In a third embodiment, the hood ceiling or the intermediate structure in connection with the ceiling is inclined. This inclined ceiling or intermediate structure is wetted from the top edge of the bottom side. Thus the water runs along the bottom side of the ceiling or the intermediate structure and cleans it. Such a construction enables keeping the hood cleaned thanks to the continuously operating cleaning. When the dirt is washed off from the surface before it is richly accumulated, it cannot drip onto the web. Continuous washing of the hood's inclined front cover is advantageous.

In a fourth embodiment, the hood ceiling or the intermediate structure in connection with the ceiling is heatable. When heating the hood ceiling or the intermediate structure to a sufficiently high temperature, water steam cannot condense on the ceiling surface. As condensation of water steam is prevented, neither will dirt stick to the surface very easily, and the surface is kept cleaner. When dirt does not stick to the surface, it will not drip onto the web. Advantageously the ceiling itself is heated, whereby a simple construction can be achieved.

In a fifth embodiment, ventilation of the hood's upper part and flow directing air curtains are used to prevent access of dirt to the ceiling constructions. When preventing the contact of dirt with the hood ceiling by means of ventilation, a situation is achieved in which the hood ceiling does not get soiled. Thus dirt will not drip from the ceiling onto the web.

In addition to soiling of the ceiling, wall soiling can also be intensive. Cleaning the wall segments is thus important when striving at more economical paper and board production. In a sixth embodiment, the hood surprisingly includes a cleaning station adapted to clean the openable wall segments of the hood. The openable wall segments are located at least on the front side of the machine. Cleaning the walls is important and cleaning prevents the detachment of dirt from the walls in a way that could disturb the process.

The invention is described below in detail by making reference to the enclosed drawings, which illustrate some of the embodiments of the invention.

DESCRIPTION OF THE PREFERRED EMBODIMENTS

Figure 1:
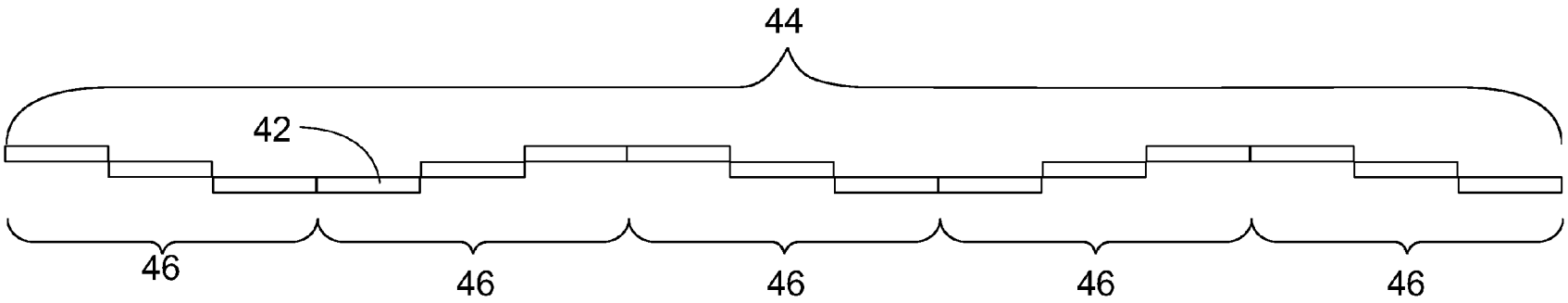
FIG. 1 is a top schematic view of how the wall of the hood according to the invention is composed of groups of wall segments.
Figure 8:
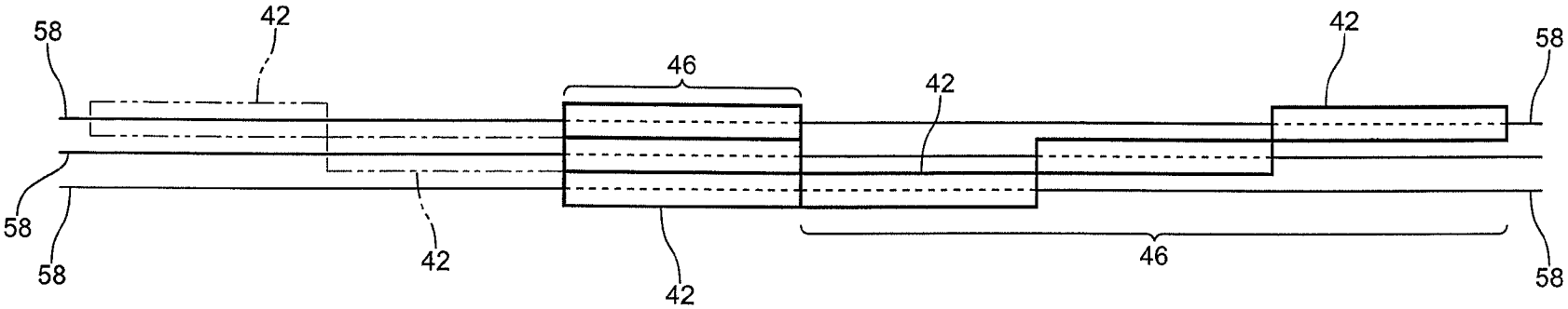
FIG. 8 is a schematic top plan view showing the front side wall segments arranged on adjacent rails, and shown with one group of front side wall segments open to provide access to the paper, board, tissue, or pulp machine, and one group of front side wall segments shown closed.

FIG. 1 provides a top view of a wall 44 of a hood according to the invention. The wall includes two or more groups. The figure shows that this wall 44 is composed of five groups 46. Each group, in turn, includes two or more wall segments. FIG. 1 shows that each group 46 is composed of three wall segments 42. FIG. 8 shows one group 46 of front side wall segments 42 opened by movement on rails 58 to provide access to the paper, board, tissue, or pulp machine, and one group of front side wall segments 46 shown closed and spaced along the rails 58. The groups function as modules of which the hood is assembled. Such a modular assembly enables notable savings through a centralized manufacture. In addition, assembling the hood using modules is carried out much faster than when constructing the hood on site. Advantageously the groups have 3-10 wall segments, whereby the group is kept suitably thin. The wall segments of which the group is composed can be all similar. Advantageously there are mostly only a few different kinds of wall segment at the maximum, enabling larger production series. Advantageously the number of groups is 5-50. As mentioned above, the groups can be composed of similar wall segments. In addition, the groups can be similar to each other. Groups similar to each other reduce the production costs. In addition, when installing groups similar to each other, the installation is carried out fast. A hood assembled of modules provides thus efficiency and savings both for the component manufacture and for the hood assembly in place.

Figure 2:
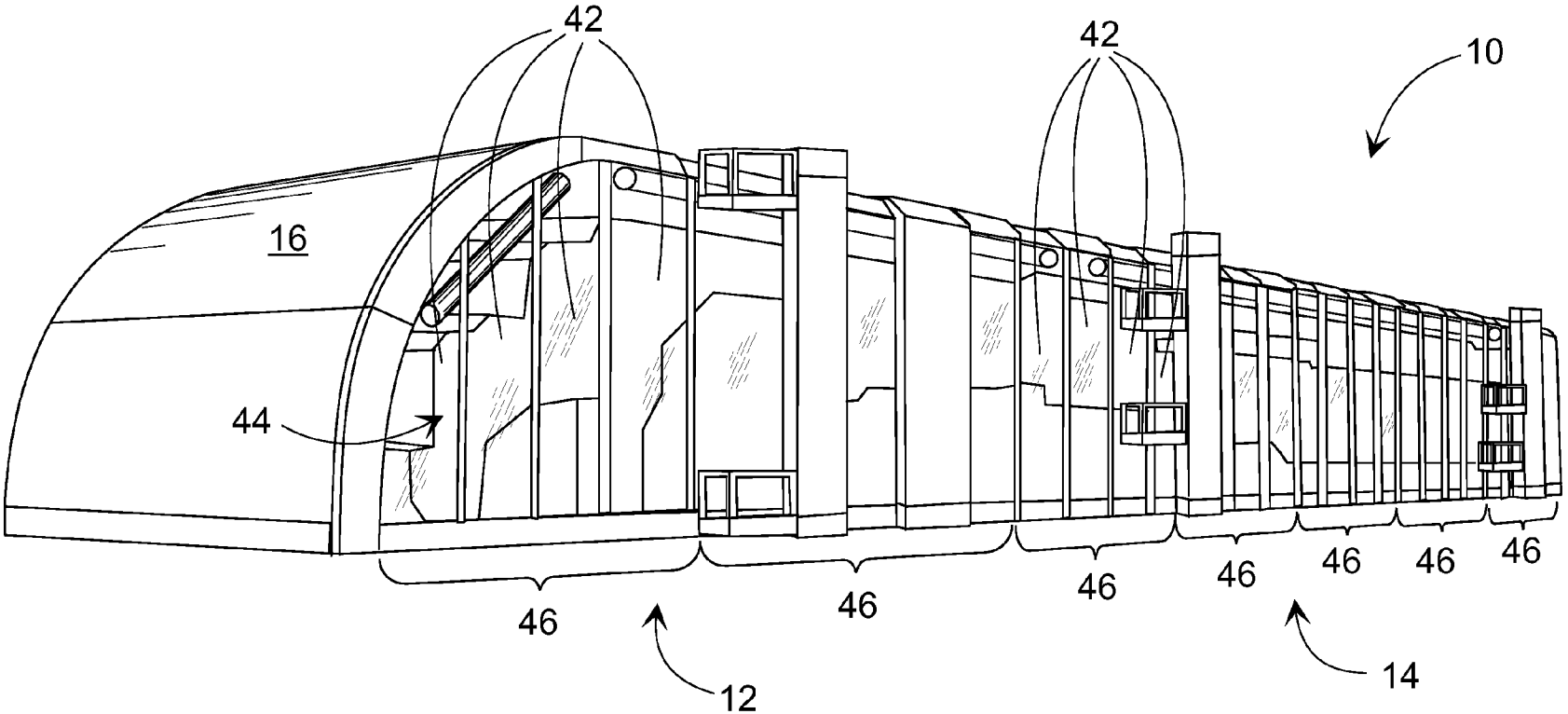
FIG. 2 is a front elevational perspective view of the hood according to the invention provided with a front cover.
Figure 6:
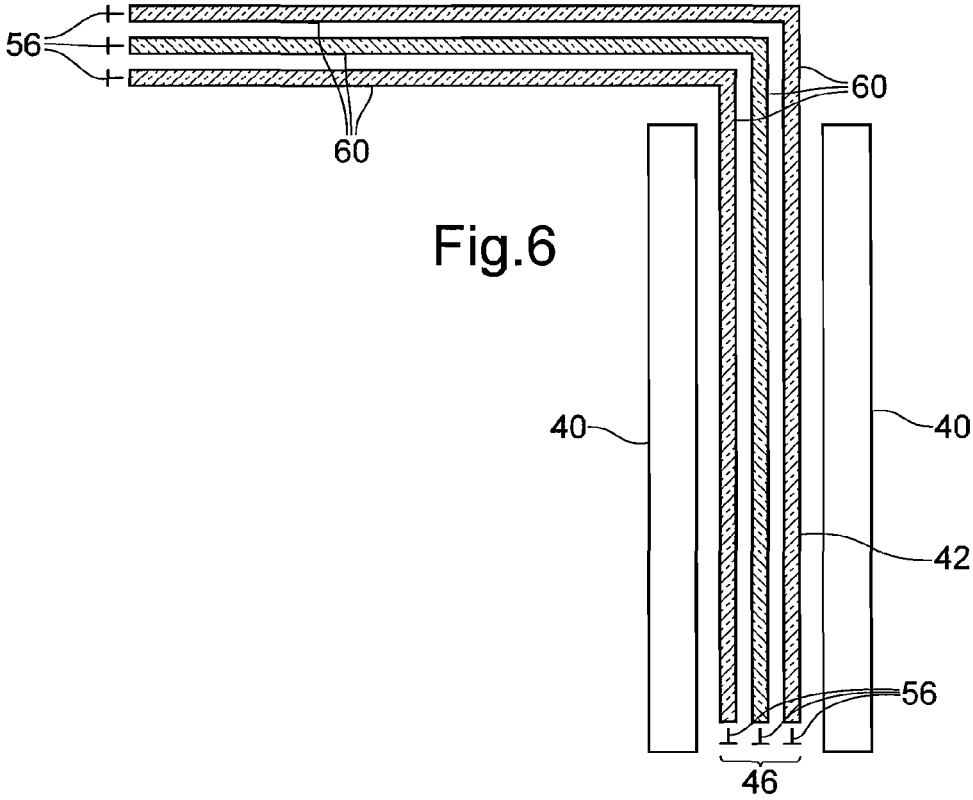
FIG. 6 is a schematic front elevational view of front side wall segments and ceiling segments of the same L element shape.
Figure 7:
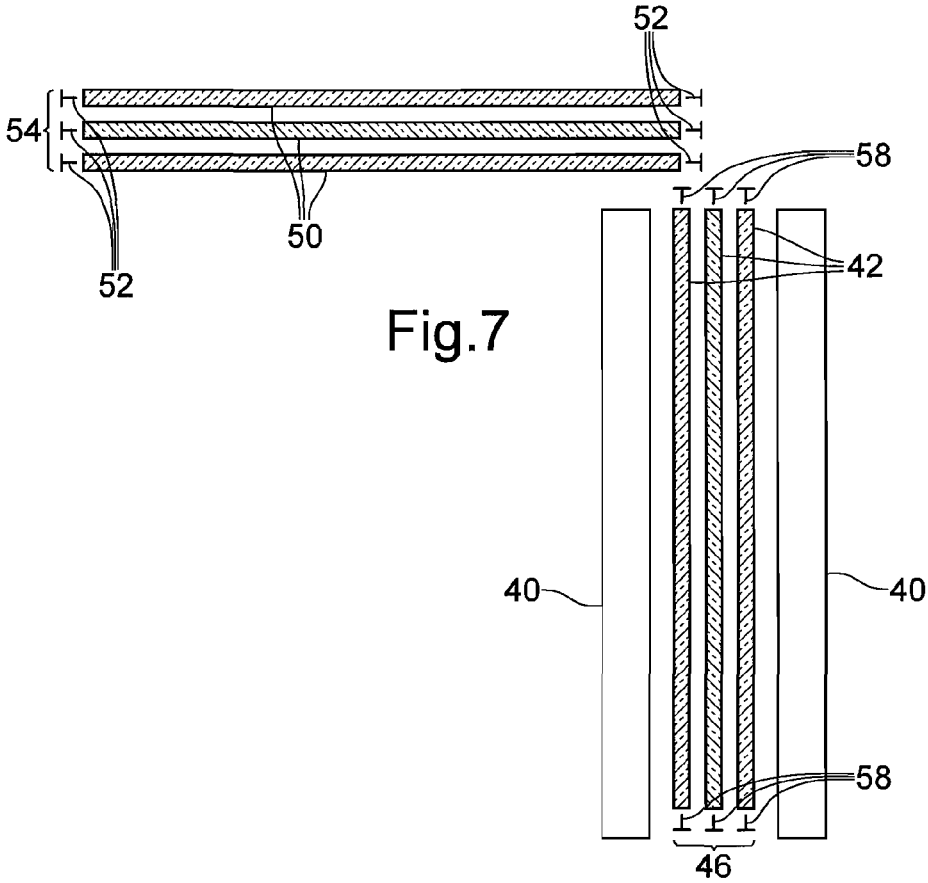
FIG. 7 is a schematic front elevational view showing separate front side wall segments and separate ceiling segments.

In the application according to the invention shown in FIG. 2, the wall 44 of the hood 10 is composed of seven groups 46. Each group 46, in turn, is composed of four wall segments 42. The first three wall segments 42 are different due to the hood design, but otherwise the wall segments are similar. In addition to the front side wall segments, the hood ceiling segments 50, shown in FIG. 7, are openable. The possibility of opening the ceiling segments supported by rails 52 or similar, for example, facilitates carrying out maintenance operations. For example, part of the rolls can be set in place through the openable ceiling. Opening of the ceiling segment is enabled by the ceiling elements 50 included in the ceiling 30. The ceiling elements 50 form a ceiling group 54. The modular composition of the ceiling also enables manufacturing and assembling the hood more cost-efficiently. As shown in FIG. 6, the elements 60 included in the ceiling and the wall segments included in the front side wall are advantageously of the same L element for the shape. Thus for moving them, a shared pair of rails 56 is sufficient. A construction provided with only one pair of rails is simple for the implementation. In another advantageous embodiment, the hood includes rails 52 of their own for the ceiling elements and rails 58 for the wall segments 42. This is an advantageous embodiment because then the elements and the wall segments move independently of each other. An independent movement enables, for example, opening only the wall segment 42 while the ceiling is kept closed.

In the application according to the invention shown in FIG. 2, the hood 10 located above the web forming section 12 and the press section 14 is provided with a front cover 16. The front cover 16 is curved in the case of the figure. A curved design is advantageous since curved blocks can be conveniently placed on top of each other when opening the front cover. The construction is thus very compact in the opened state. In addition, a curved construction can be implemented very cost-efficiently utilizing a known technique.

Figure 3:
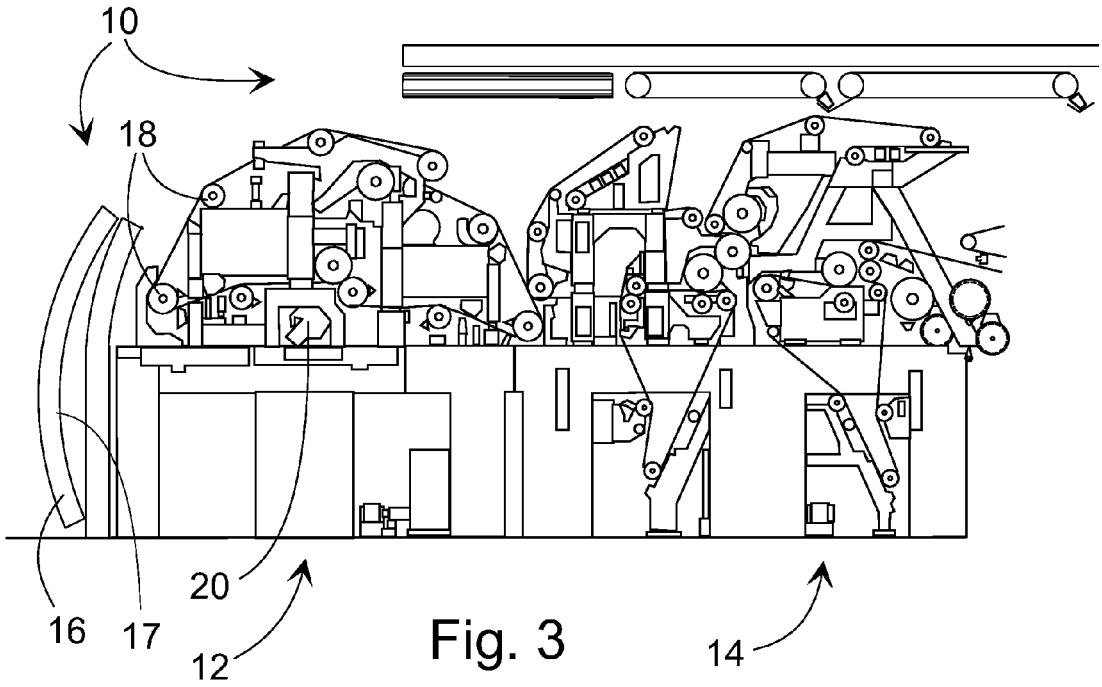
FIG. 3 is a front elevational view of the hood according to the invention with a front cover open.

In the hood 10 according to the invention, as shown in FIG. 3, located in connection with a web forming section 12 and a press section 14, the front cover 16 is open. Operations can be carried out in the web forming section 12 through an open front cover 16. The opening created by opening the front cover 16 enables replacing the rolls 18 and maintenance of the headbox 20, for example. Maintenance possibilities provided by an openable front cover depend on the machine construction. In any event, an openable front cover enables carrying out the machine's maintenance operations very close to the machine. With a curved design a very efficient use of space can be achieved.

Figure 4:
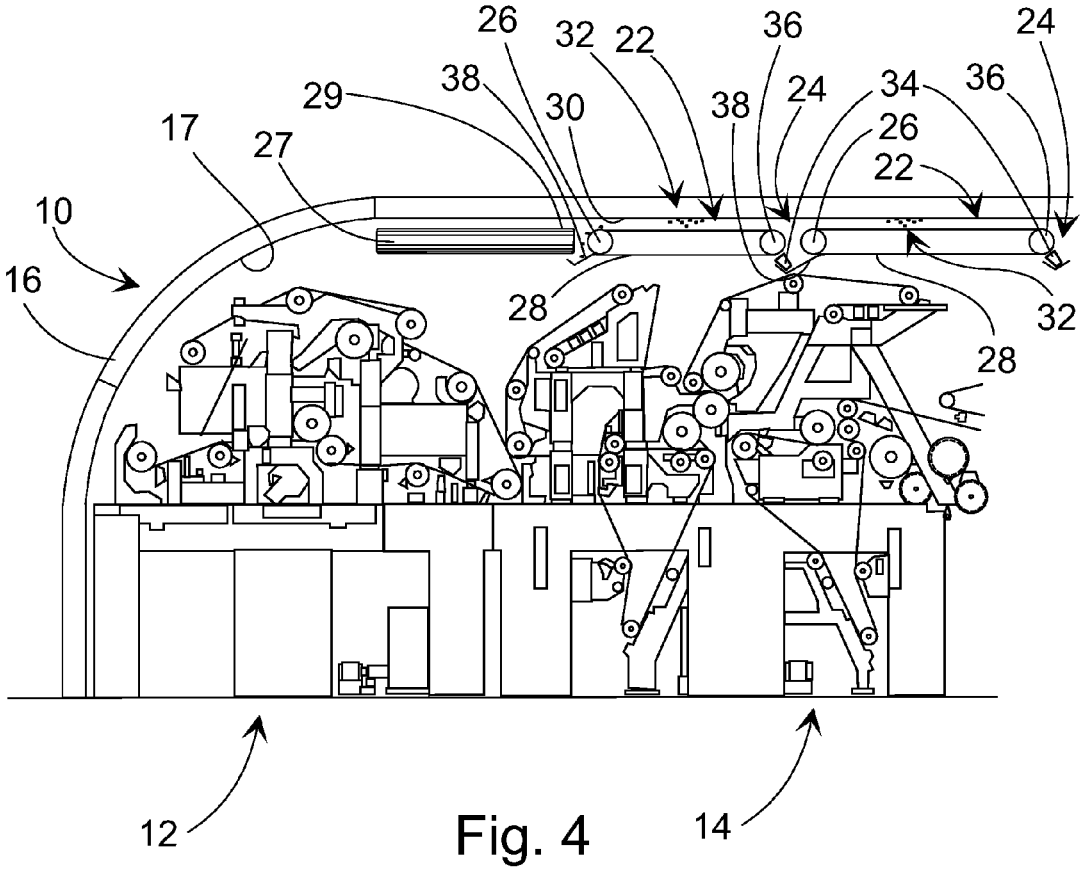
FIG. 4 is a front elevational view of the hood according to the invention to be located above a web forming and a press section, in which is shown a dirt-collecting intermediate structure and its cleaning equipment are included in connection with the hood.

In the application according to the invention shown in FIG. 4, the hood 10 located in connection with the web forming section 12 and the press section 14 includes a dirt-accumulating intermediate structure 22 as well as cleaning equipment 24 for cleaning the intermediate structure. The intermediate structure is installed between the ceiling 30 of the hood 10 and the web forming section 12 and the press section 14. Advantageously the intermediate structure includes a fabric 28 and fabric cleaning equipment 34. In addition, the construction includes support rolls 26, 36 by which the fabric 28 is adapted to rotate as an endless loop. The fabric can also rotate in the cross direction of the machine, such as the fabric 29. This fabric is supported to rotate by means of front rolls, of which the figure shows the front roll 27, which does not have cleaning equipment associated with it. With an embodiment of the intermediate structure 22 in which the intermediate structure is composed of a continuously cleanable fabric, a situation can be achieved in which on top of the produced web there is always a sufficiently clean fabric 28, 29 as an intermediate structure 22. Sufficient cleanliness refers here to that nothing drips onto the web from the fabric. The cleanliness level can be adjusted with the fabric cleaning efficiency and with the fabric rotation speed. The fabric rotation can be relatively slow compared to the rotation of fabrics taking place on the machine itself. For example, if a hood covering the web forming and the press sections has three fabric loops, it is sufficient to clean each of them approximately once in half an hour. In case soiling causes problems with this cleaning frequency, the cleaning frequency can be notably reduced by increasing the fabric rotation speed.

In the application shown in FIG. 4, the fabric 28 is continuously cleaned providing thus always a clean fabric above the produced web. Thus impurities cannot drip onto the web from the ceiling 30 or from the intermediate structure 22. Besides guaranteeing a clean fabric above the web, this construction slows down soiling of the hood ceiling. In case the ceiling 30 of the hood 10 nonetheless soils with long cleaning shutdown intervals, dirt 32 dripping from the ceiling 30 falls on top of the fabric 28 functioning as the intermediate structure 22. In other words, the fabric 28 prevents soiling of the hood 10 ceiling 30 and dirt 32 dripping from the soiled ceiling 30 onto the web forming section 12 and/or the press section 14. The fabric 28 is cleaned using a fabric cleaning device 34. The fabric cleaning device 34 is advantageously a cleaner that is used to clean the fabric against a support roll 36, which turns the outer side of the fabric, previously the bottom side, as the top side. A cleaner can make the fabric very clean. When cleaning is performed against a support roll, spreading of cleaning water is prevented and the washing event is well controllable. In connection with the support roll 26, which turns the outer side of the fabric, the top side, as the bottom side, there is a saveall 38 to which impurities 32 that have possibly dripped onto the fabric 28 from the hood 10 ceiling 30 are further dripping. Instead of the saveall 38, a cleaner can be used, but an advantageous solution is such that there is only one cleaner in connection with the support roll 36, which turns the outer side of the fabric to the top. The principle of one cleaner is advantageous because a simple embodiment can then be achieved. Locating the cleaner at the roll that turns the fabric's outer side as the top side contributes to detaching the dirt before the dirt sticks to the fabric. Dirt 32 dripping onto the fabric 28 from the ceiling 30 drips further to the saveall 38 from the fabric.

The inner surface 17 of the front cover 16 of the hood shown in FIG. 4 can be continuously cleaned with running water. When locating the cleaning devices, attention should be paid to that the front cover is sufficiently inclined for preventing water dripping. Cleaning the hood's front cover with a continuous water flow is very advantageous, because the inner surface of the front cover is ready inclined.

Figure 5:
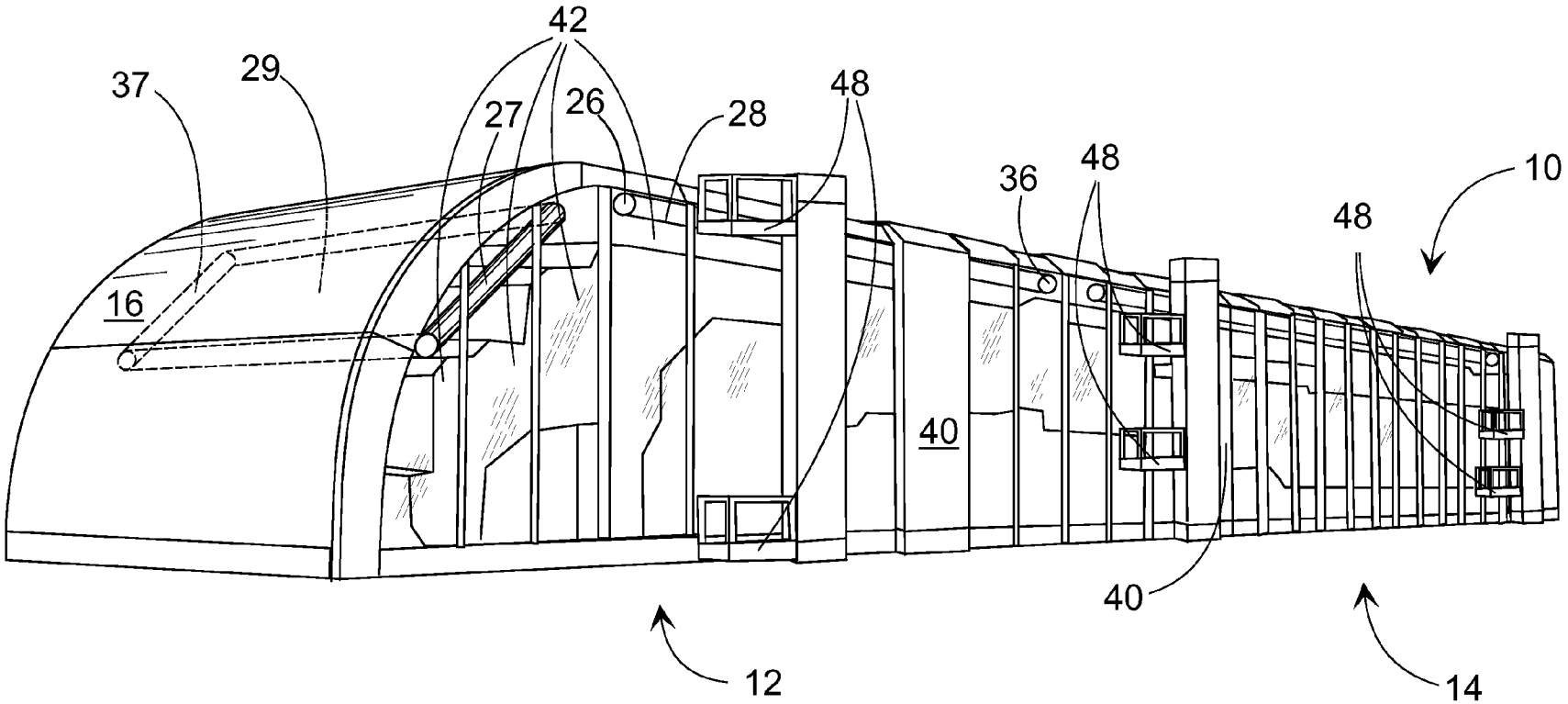
FIG. 5 is a front elevational perspective view of the hood according to the invention which shows an embodiment of a hood according to the invention to be located above a web forming and a press section provided with wall segment cleaners.

In the application according to the invention shown in FIG. 5, the front side wall 44 of the hood 10 comprises wall segments 42. The hood 10 also comprises an inclined front cover 16. Included in connection with the front cover there are front rolls 27, 37 for supporting the fabric 29. The fabric 29 in connection with the front cover 16 is adapted to rotate in the cross direction of the machine. On the other hand, fabrics 28 located in other parts of the machine are supported with support rolls 26, 36 to rotate in the machine direction. The rotation directions of the fabrics are appropriately selected. The fabrics can be located in the machine direction or in the cross direction as desired, while FIG. 5 shows only one embodiment.

In the application according to the invention shown in FIG. 5, included in connection with the hood 10 located in connection with a web forming section 12 and a press section 14 there are cleaning stations 40 for the wall segments 42. The cleaning event can be automated such that cleaning is always carried out automatically when the wall segments open. With this arrangement a situation can be achieved in which the wall segments are kept clean all the time. When cleaning is carried out automatically, personnel is not committed to performing it. Efficient and automatic wall segment cleaning enables thus efficient production for its part. Wall segment cleaning can be carried out using water, a brush, or air. These techniques can also be combined. Advantageously cleaning is carried out with pressurized water. Thus it is possible to clean also the notches present in the surfaces. For preventing splashing of pressurized water, in addition to the cleaning nozzle, the cleaning head is composed of splash guards placed laterally to it. At the same time, the splash guards function as collectors of dirty water such that dirty water can be collected and removed using them. Collected dirty water is controllably led out of the machine avoiding thus soiling caused by it.

In the hood 10 according to the invention shown in FIG. 5, the front side wall segments 42 are transparent for an area of more than 50%, advantageously of more than 70%. This transparency is important in order that the machine operating personnel can monitor the machine operation during the production. The transparent area of the wall segments is advantageously made of thermally insulated glass elements. Glass is a very suitable material for use in a paper machine since glass endures multiple cleaning operations and it is not harmed by chemicals. In addition, wide experience is available for the manufacture of thermally insulated glass elements, whereby problems do not arise from their manufacture. Thermally insulated glass elements prevent accumulation of water on the surfaces. In addition, thermal insulation is needed to avoid heating up of the mill hall. When the wall segments are transparent, their cleaning is important also for maintaining the transparency enabling thus better machine monitoring.

FIG. 5 shows a hood according to the invention seen from the front side. In one embodiment the walkways 48 are separated from the machine frame. In other words, the walkways 48 are not supported to the machine frame. The walkways are movable and their location can be adjusted both in the vertical direction and in the longitudinal direction of the web forming machine. Such walkways are very advantageous to use because they need not be removed for a fabric change. It is sufficient to guide the walkways aside in locations in which they would otherwise interfere with the fabric replacement. With such walkways for example a device according to patent publication FI 103421 is used, which enables a paper machine without cantilevering. Using such a device, a gap is created between the frame beams of the paper machine by lifting the frame beams and separating them from each other. Such a comprehensive solution in which a gap is achieved between the frame beams for a fabric replacement without cantilevering combined with walkways that are separate from the machine, enables replacing the fabric faster than before. In addition, other maintenance operations of the machine are also more flexibly performed.

The hood shown in FIGS. 2-5 can be easily modified to cover also the dryer section in addition to the web forming and press sections. In such a version, a separating wall is advantageously present between the dryer section and the press section for separating the dryer section into a moisture/heat department of its own. The number of separating walls can also be more than one whereby it is possible to optimize desired moisture/heat conditions for each machine section. The hood shown in FIGS. 2-5 covers only the web forming and the press sections. Thus this hood is suitable for use as such in connection with old dryer section hoods. Thus the invention can be applied in connection with a machine modernization, for example, constructing a hood only above the web forming and/or the press section.

In one embodiment the back side wall includes several groups which further include staggered wall segments. Such a back side wall construction is openable. The construction of the openable back side wall segment can be implemented, for example, by using a structure in which motors are directly connected to the roll ends. This construction enables using similar solutions in the back side wall implementation as have been used on the front side.

The invention claimed is:

1. A hood for a paper, board, tissue, or pulp machine, the hood comprising:

a ceiling, a back side wall, and a front side wall arranged to enclose at least a portion of a paper, board, tissue, or pulp machine, the hood being located about a portion of a paper, board, tissue, or pulp machine;

wherein the front side wall includes staggered front side wall segments mounted for movement along rails;

wherein there are at least six front side wall segments mounted for movement in a machine direction along rails arranged so that at least two groups of at least three front side wall segments are arranged for movement along the rails, said movement forming at least two groups of at least 3 overlapping front side wall segments, and gaps therebetween so providing access to the paper, board, tissue, or pulp machine;

wherein each group of at least three front side wall segments forms a module of similar front side wall segments from which the hood is constructed;

wherein the ceiling includes staggered ceiling segments not attached to the front side wall or back side wall and mounted for movement on rails; and wherein there are at least two ceiling segments mounted for movement in a machine direction along rails arranged so that said movement forms at least two overlapping ceiling segments, said movement providing an opening in the ceiling for access to the paper, board, tissue, or pulp machine.

2. The hood of claim 1 wherein the number of groups is 5-50.

3. The hood of claim 1 wherein the hood has portions forming a front cover positioned above an initial part of the paper, board, tissue, or pulp machine, the front cover having a bottom side, the bottom side having a top edge, the front cover being movable, said movement forming an opening which provides access to the initial part of a paper, board, tissue, or pulp machine;

wherein the front cover slopes downwardly toward the initial part of the paper, board, tissue, or pulp machine, and a source of water positioned at the top edge of the bottom side of the cover so that water flows along the bottom side of the front cover and does not drip on to a web being formed.

4. The hood of claim 3 wherein the front cover has a semi-cylindrical shape.

5. The hood of claim 1 wherein the hood includes an intermediate structure having a fabric supported on rolls and cleaning equipment, positioned between the hood ceiling and a web forming section, press section or dryer section, the said cleaning equipment being in cleaning engagement with the fabric of the intermediate structure.

6. The hood of claim 5 wherein the fabric supported on the rolls forms an endless loop which is mounted to rotate on said rolls, and wherein the cleaning equipment is arranged opposite at least one roll of the support rolls with the fabric therebetween, so that the endless loop is cleaned as the fabric rotates about the at least one roll.

7. The hood of claim 1 wherein the front side wall segments have a total area, and wherein more than fifty percent of the total area comprises transparent portions.

8. The hood of claim 7 wherein the transparent portions of the front side wall segments are made of thermally insulated glass elements.

9. The hood of claim 1 further comprising a cleaning station positioned to engage the front side wall segments;

wherein the cleaning station is positioned so that the front side wall segments pass through said cleaning station automatically upon opening of the front side wall segments.

10. The hood of claim 1 wherein the back side wall is comprised of a plurality of back side wall segments which are arranged in a plurality of groups, each group including a plurality of staggered back side wall segments.

11. The hood of claim 10 wherein there are at least six back side wall segments mounted for movement in a machine direction along rails arranged so that at least two groups of at least three back side wall segments are arranged for movement along the rails, said movement forming at least two groups of at least 3 overlapping back side wall segments, and gaps therebetween so providing access to the paper, board, tissue, or pulp machine; and wherein each group of at least three back side wall segments forms a module of similar back side wall segments from which the hood is constructed.

12. The hood of claim 11 wherein each group of front side wall segments contains at least 4 front side wall segments and wherein each group of back side wall segments contains at least 4 back side wall segments.

13. The hood of claim 1 wherein each group of front side wall segments contains at least 4 front side wall segments.

* * * * *